US006547627B1

(12) United States Patent
Oathout

(10) Patent No.: US 6,547,627 B1
(45) Date of Patent: Apr. 15, 2003

(54) GAME CALLING DEVICE HAVING ADJUSTABLE PITCH, INTENSITY, TONE AND INFLECTION

(75) Inventor: David E. Oathout, 129 Fulton Rd., Caroga Lake, NY (US) 12032

(73) Assignee: David E. Oathout, Caroga Lake, NY (US)

( * ) Notice: Subject to any disclaimer, the term of this patent is extended or adjusted under 35 U.S.C. 154(b) by 0 days.

(21) Appl. No.: 09/934,677

(22) Filed: Aug. 23, 2001

(51) Int. Cl.[7] ..... A63H 5/00
(52) U.S. Cl. ..... 446/208
(58) Field of Search ..... 446/202, 207, 446/208, 209, 416, 486; 84/410, 364, 456

(56) References Cited

U.S. PATENT DOCUMENTS 1,052,525 A * 2/1913 Smith ..... 116/137 R
2,072,786 A * 3/1937 Yager ..... 446/208
2,544,370 A * 3/1951 Walther ..... 446/208
3,020,675 A 2/1962 Boecker
4,940,451 A 7/1990 Leady
5,577,946 A 11/1996 Oathout
5,643,039 A * 7/1997 McIntyre ..... 446/208

* cited by examiner

*Primary Examiner*—Jacob K. Ackun
(74) *Attorney, Agent, or Firm*—Oliff & Berridge, PLC

(57) ABSTRACT

A game calling device includes a tubular member, a reed and an elastic skin. The tubular member also has a mouthpiece end that allows air to enter or exit and an outlet end that allows sound to be emitted from the device. The reed vibrates in response to passing air and is disposed within the tubular member. A control rod makes movable contact with the reed, allowing the user to vary the pitch, intensity, tong and/or inflection of the sound emanating from the device.

21 Claims, 3 Drawing Sheets

GAME CALLING DEVICE HAVING ADJUSTABLE PITCH, INTENSITY, TONE AND INFLECTION

BACKGROUND OF THE INVENTION

1. Field of Invention

The present invention relates to game calling devices, and in particular, to a game calling device that can produce sounds having varied pitch, intensity, tone and inflection.

2. Description of Related Art

Game calling devices for large mammals and predators are known, in particular, devices known as "grunt tubes" are used to simulate the grunts, snorts, bleats and other sounds produced by White Tailed deer. White Tailed deer sounds are described by Atkenson et al. In "Vocalizations of White Tail Deer," 120 The American Midland Naturalist 195 (1988). Hunters and wildlife enthusiasts use grunt tubes to attract deer and other animals.

Grunt tubes generally include a tubular member through which air passes over a reed supported within the tubular member. The passing air excites the reed and causes it to vibrate and to produce sounds.

U.S. Pat. No. 5,577,946 to Oathout discloses such a game caller in which the user can modify the sounds emanating from the outlet end produced by air passing through the mouthpiece and over the reed by selectively applying pressure to an elastic skin stretched over an opening in the tubular member.

U.S. Pat. No. 3,020,675 to Boecker discloses a goose caller in which the user depresses a pin to contact the reed and control its vibration, thereby changing the pitch of the sounds produced by the goose caller.

U.S. Pat. No. 4,940,451 to Leedy discloses an adjustable game calling device having a trombone-like tuning member in sliding contact with a single point on a reed that the user positions axially to change the effective length of the reed.

The devices of the prior art, however, fail to provide the user with the capability of varying the inflection, pitch, intensity and/or tone of the sounds by manually adjusting the device in a way that allows the sounds to be consistently reproduced.

SUMMARY OF THE INVENTION

An object of the invention is to provide a game calling device in which sounds having varied pitch, intensity, tone and/or inflection can be produced consistently.

Another object of the invention is to produce a game calling device that can produce varied sounds without manipulating the device by hand.

Still another object of the invention is to provide a game calling device having a control rod that can be manipulated by hand to place pressure on the reed and produce varied sounds.

These and other objects are achieved by the game calling device of the present invention. The game calling device includes a tubular member, a reed, an elastic skin and a control rod. The tubular member includes a mouthpiece end that allows air to enter the tubular member, an outlet end that emits sounds, and an opening in a wall of the tubular member between the mouthpiece end and the inlet end. The reed vibrates in response to passing air and is disposed within the tubular member adjacent the mouthpiece end and the opening. The elastic skin extends over the wall of the tubular member to at least partially cover the opening. The user can modify the sounds emanating from the outlet end of the device by selectively moving the control rod axially to contact the reed and change the vibrational characteristics of the reed. For instance, when the control rod is moved in such a way as to increase the length of reed that may vibrate, a low pitched sound may result. Conversely, decreasing the length of reed that may vibrate may result in a higher pitched sound emanating from the device.

The tubular member preferably includes a mouthpiece for the user to inhale or exhale air through the device. Within the tubular member, a plate member having an air channel that extends along an axis of the mouthpiece supports a reed connected to the plate member at one end. The plate member preferably includes an upstream end disposed adjacent the mouthpiece end. The reed preferably includes an upstream end that is also disposed adjacent the mouthpiece end and a downstream end. The downstream end of the reed is connected to the downstream end of the plate member. The upstream end of the reed is free to vibrate.

The upstream end of the plate member preferably includes an end wall that forms an end to the air channel. The upstream end of the plate member is preferably tapered. The reed is preferably attached to the plate member. The game calling device preferably includes a support member to which the reed and plate member are attached. The support member supports the reed and the plate member such that the reed and plate member do not contact the wall of the tubular member.

The elastic skin preferably extends to at least partially cover the opening. The opening preferably includes an upstream end, a middle portion and a downstream end. The opening preferably widens from the upstream end to the middle portion, and narrows from the middle portion to the downstream end.

The game calling device of this invention has a control rod that allows the user to control the vibration of the reed in such a way as to vary the inflection of the sounds as well as their pitch, intensity and tone.

In one embodiment, the control rod is manipulated manually with a ball handle attached to one end. On the other end of the control rod is a roller that makes contact with the reed. The elastic skin urges the roller against the reed allowing the roller to make continuous contact with the reed. The elastic skin also allows the user to note the position of the roller on the reed by visually inspecting the outer surface of the elastic skin.

In this embodiment, a barrel portion is connected to a tubular member to enhance the sound created by the device. The ball handle of the control rod is located on the downstream end of the barrel and the control rod extends through the barrel into the tubular member where it is connected to the roller. In this embodiment, the user exhales into the device to excite the reed and create sound. In other embodiments, a user may inhale to create air flow through the device also creating sound. In this embodiment, the user may adjust the quality of the sound manually with the control rod and, once the desired sound quality is achieved, the control rod may be left in that position to consistently reproduce the sound.

In another embodiment, the game calling device of this invention may be operated in a hands free mode. In this embodiment, a tubular member has a mouthpiece connected to one end. Within the mouthpiece is a support member that fixes the plate member and reed within the device. A control rod extends from the opening of the mouthpiece through a hole in the support member and ultimately makes contact with the reed inside the tubular member. The control rod of this embodiment may be manipulated by the teeth or tongue of the user in a completely hands free mode of operation. The control rod has a hooked end which extends from the mouthpiece and a contact end opposite the hooked end for making contact with the reed. The control rod may be of a semi-flexible or resilient material and curved in such a way as to make contact with the inner surface of the tubular member at the mid-section so as to slidably maintain contact between the contact end of the control rod and the reed over a full range of motion.

In this embodiment, the user inhales to create airflow through the device exciting the reed. This may be particularly advantageous during cold weather in that moisture from the user's breath will not freeze on the device, which would cause the reed to become immobile. In this embodiment, a screen or cover may be placed over the outlet end of the tubular member to prevent the user from inhaling insects or other foreign objects. One skilled in the art will realize that the game calling device of this embodiment may be configured to allow the user to exhale rather than inhale to create the desired sound.

These and other features and advantages of this invention are described in, or are apparent, from the following detailed description of the preferred embodiments.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
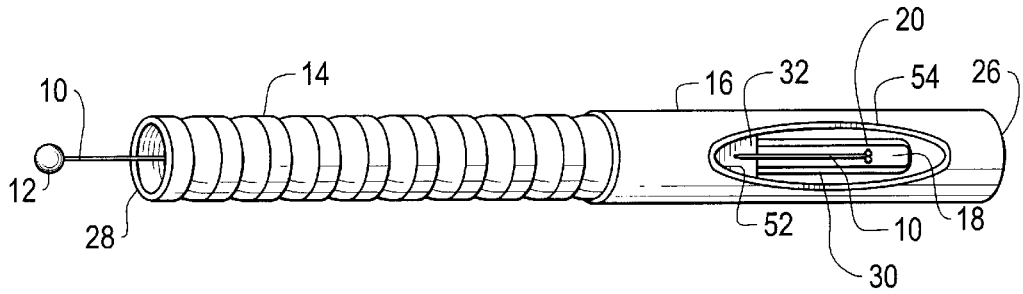
FIG. 1 is a perspective view of the game calling device of this invention having a manually operated control rod and a barrel section that is connected to the tubular member.

FIG. 1 is a perspective view of an embodiment of a game calling device having a tubular member 16 connected to a barrel section 14. The tubular section 16 has a mouthpiece 26 into which the user exhales to excite a reed 18. The reed and its supporting structure are located adjacent an opening 54 in the tubular member 16. Sound emanates from the outlet 28 of barrel 14 as the user exhales into the mouthpiece 26 to vibrate the reed 18. One skilled in the art will realize that the game caller of this invention may be configured so as to allow the user to inhale or exhale to vibrate the reed 18 and create the desired sound as well as vary the inflection, pitch, intensity and tone of the sound.

A control rod 10 extends longitudinally through the barrel section 14 and tubular member 16. The control rod 10 has a handle 12 on one end and a roller 20 on the opposite end which maintains movable contact with the reed 18. A support member 32 (FIG. 3) is fixed within the tubular member 16 and holds a plate member 30 and reed 18 at a fixed location inside the tubular member 16. The control rod 10 extends through a hole 52 located in the support member 32.

Figure 2:
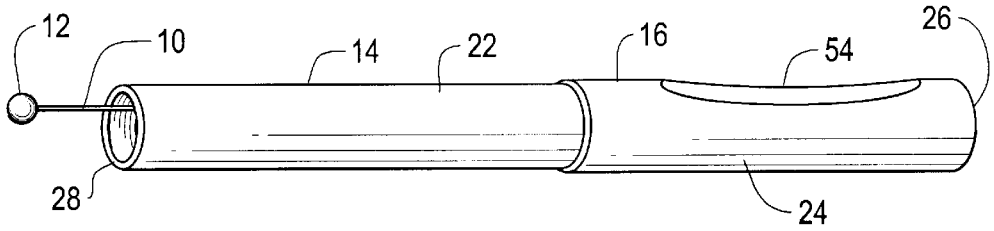
FIG. 2 is a perspective view of the game calling device of this invention having an elastic skin that covers the tubular member as well as the barrel section.

FIG. 2 shows the game caller covered in elastic sheathing 24. The tubular member 16 is connected to the barrel 14 by the elastic sheathing 24. The barrel section 14 is also covered by elastic sheathing 22. The control rod 10 having the handle 12, such as the illustrated ball handle, is protruding from the outlet 28. In this embodiment, the sheathing 24 extends over the opening 54. The sheathing 24 retains the barrel section 14 against the tubular member 16 to create an integral unit. The sheathing 22 extends over the entire barrel section 14 and assists in maintaining the barrel section 14 in close contact with the tubular member 16. The sheathing 22 and sheathing 24 also improve the user's ability to grip the device.

Figure 3:
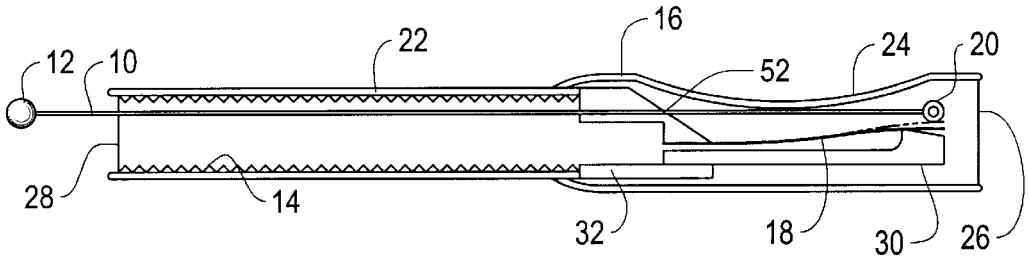
FIG. 3 is a cross-sectional view of the preferred embodiment of this invention that illustrates the inner workings of the tubular member, the barrel section, and the manually operated control rod.

FIG. 3 is a cross-sectional view of the game calling device. The plate member 30 and reed 18 are fixed in place by the support member 32. The control rod 10 slidably extends through the hole 52 in the support member 32. Sound is created when air from the user inhaling or exhaling through the mouthpiece 26 passes the reed 18 and plate member 30 and excites the reed 18, causing it to emit sound. The quality of this sound can be varied by extending or retracting the control rod 10, causing the roller 20 to make contact with the reed 18 at varying locations along its length. The sheathing 24 urges the roller 20 against the reed 18 so that the roller 20 remains in contact with the reed 18. The sheathing 24 also holds the roller 20 stationary in the desired position. Sliding the control rod 10 in an axial direction out of the device causes a greater length of a non-fixed portion of the reed 18 to be free to vibrate, creating a lower pitch sound. Conversely, sliding the control rod 10 in the opposite axial direction reduces the non-fixed length of the reed 18 that is free to vibrate, thus producing a higher pitch sound. Once the user identifies a desired sound quality to be produced by the game calling device of this invention, the control rod 10 may be left at the corresponding position for the desired sound because the sheathing 24 holds the roller 20 stationary. In this way, the device need not be continuously adjusted to reproduce a desired quality of sound.

Figure 4:
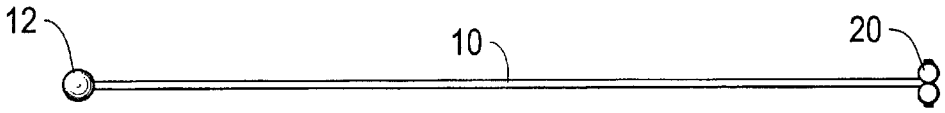
FIG. 4 illustrates a manually operated control rod of the game calling device shown in FIG. 3.

FIG. 4 is an illustration of the control rod 10 of this invention having ball handle 12 on one end and roller 20 on the opposite end. This control rod 10 allows manual adjustment of the sound quality by hand manipulation of the ball handle 12. The roller 20 maintains continuous contact with the reed 18 and may either slide or roll during operation. When the control rod 10 is left unattended, the sheathing 24 holds the roller 20 in position on the reed 18.

Figure 5:
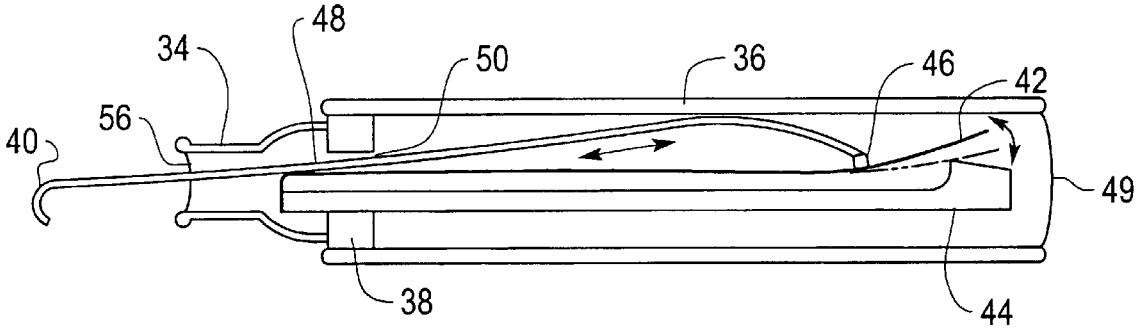
FIG. 5 is a cross-sectional view of another embodiment of the game calling device of this invention that is capable of being operated in a hands-free mode.

FIG. 5 is another embodiment of a game caller, which has a tubular member 36 connected to a mouthpiece 34. A plate member 44 and reed 42 are fixed in a support member 38. A hands-free control rod has a hooked portion 40 and a contact end 46 that maintains slidable contact on the reed 42.

The tubular member 36 has an inlet 49 that communicates with mouthpiece 34 and allows the user to inhale air, exciting the reed 42. Mouthpiece 34 has opening 56 that allows the user to draw air into the device and through the inlet 49. The hooked portion 40 of the control rod 48 allows the user to manipulate the control rod with the user's tongue or teeth while holding the game calling device in the user's mouth via the mouthpiece 34. The control rod 48 extends axially through a hole 50 in support member 38. This allows for hands-free operation because the user can: 1) hold the game caller in the user's mouth and manipulate the control rod by tongue or teeth; and 2) simultaneously hold a gun, camera or telescope with the user's hands. The contact end 46 of the control rod 48 maintains continuous slidable contact with the reed 42 due to the resilient nature of the control rod 48 flexably interposed between the reed 42 and the inner surface of the tubular member 36.

Figure 6:
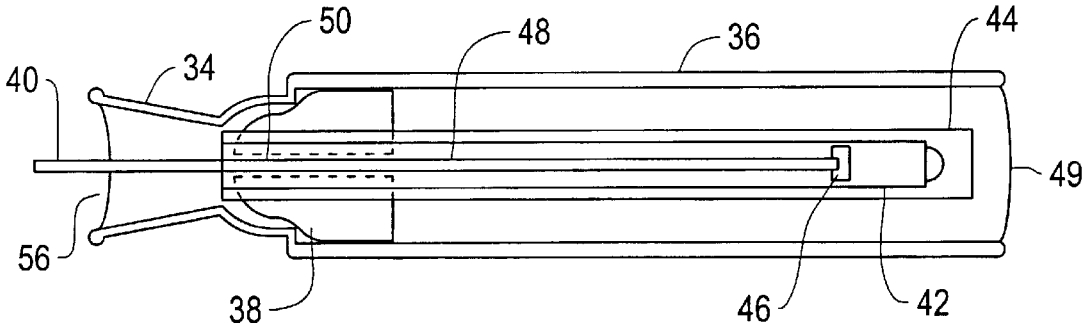
FIG. 6 is a cross-sectional view of the game calling device shown in FIG. 5 that has been rotated 90° about the longitudinal axis.

FIG. 6 is an illustration of the game calling device of FIG. 5 rotated 90° about the longitudinal axis. The tubular member 36 has mouthpiece 34 connected on its downstream side. The plate member 44 and reed 42 are fixed in place by support member 38. The hands-free control rod 48 extends longitudinally through hole 50 in support member 38 and makes slidable contact with the reed 42 via its contact end 46. The hands-free control rod 48 can be manipulated via its hooked end 40. In this embodiment, the user inhales through opening 49 creating airflow over the reed 42 causing sound to be emanated. The airflow continues through the opening 56 in the mouthpiece 34. One skilled in the art will recognize that the components of this invention may be configured to allow the user to operate the device by either inhaling or exhaling.

Figure 7:
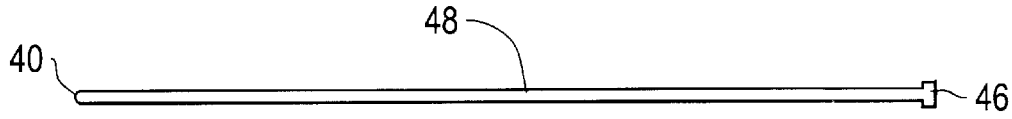
FIG. 7 is an overhead view of the hands free control rod shown in FIG. 6.
Figure 8:
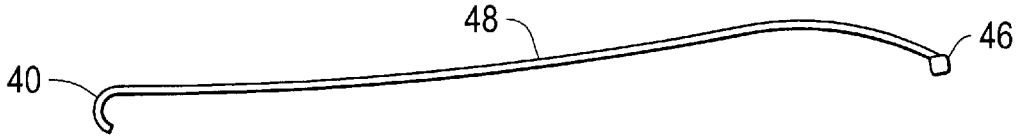
FIG. 8 is a side view of the hands free control rod shown in FIG. 7.

FIGS. 7 and 8 show an example of the hands-free control rod 48 of the game caller. The contact end 46 maintains slidable contact with the reed and hooked end 40 allows the control rod to be manipulated by the user. As described above, the user may operate the control rod 48 by manipulating the hooked end 40 with either the user's tongue or teeth while simultaneously holding the game caller in the user's mouth via the mouthpiece 34. The hands-free control rod 48 is elastic and sufficiently curved to maintain the contact end 46 in slidable contact with the reed 42. While the hands-free control rod 48 of this embodiment extends through the center portion of the opening of the mouthpiece 34, one skilled in the art will recognize that the control rod 48 may extend through an opening on the tubular member 36, or separate opening on the side of mouthpiece 34, such that the control rod 48 could be operated from the outside of the mouthpiece.

Figure 9:
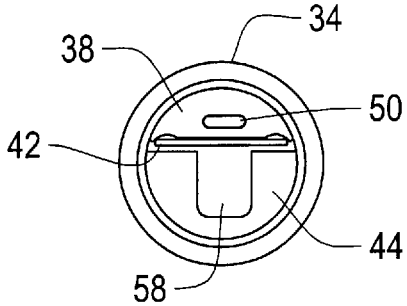
FIG. 9 is a transverse cross-sectional view of a mouthpiece for an embodiment of the game caller of this invention.

FIG. 9 is a transverse cross-sectional view of the mouthpiece. The support member 38 is maintained within the mouthpiece 34 by an interference fit. Contained within the support member are the plate member 44 and reed 42. The hands-free control rod 48 fits slidably through hole 50 in the support member 38. In this embodiment, air passing through the air channel 58 and plate 44 excites the reed 42 causing sound to emanate from the device.

While this invention has been described in conjunction with specific embodiments outlined above, it is evident that many alternatives, modifications and variations will be apparent to those skilled in the art. Accordingly, preferred embodiments of the invention, as set forth above, are intended to be illustrative, not limiting. Various changes may be made without departing from the spirit and scope of the invention.

What is claimed is:

1. A game calling device comprising:

a tubular member defining an axial direction and having a mouthpiece end that allows air to enter said tubular member, an outlet end that emits sounds, and an opening in a wall of said tubular member between said mouthpiece end and said outlet end;

a reed that vibrates in response to passing air, said reed being disposed within said tubular member adjacent said mouthpiece end and said opening;

an elastic skin extending over said wall of said tubular member to at least partially cover said opening; and a control rod located adjacent the opening and between the elastic skin and the reed for making selective movable contact with the reed, wherein air passing through said mouthpiece end and past said reed vibrates the reed to create sounds and the control rod modifies a vibrational length of the reed by contacting a selected point of contact on the reed.

2. The game calling device of claim 1, wherein said tubular member includes a barrel section connected to a downstream end of said tubular member.

3. The game calling device of claim 2, wherein said tubular member and said barrel section are connected by the elastic skin.

4. The game calling device of claim 2, wherein said tubular member includes a plate member having an air channel extending in the axial direction below the reed.

5. The game calling device of claim 4, wherein one end of said reed is connected to said plate member and an opposite end of said reed is free to vibrate.

6. The game calling device of claim 4, wherein said air channel terminates at an upstream end delimited by an end wall of said plate member that directs air towards said reed.

7. The game calling device of claim 4, wherein said plate member is tapered in the axial direction.

8. The game calling device of claim 4, wherein said mouthpiece includes a support member for supporting said reed and said plate member for selective axial positioning in the axial direction within the tubular member.

9. The game calling device of claim 4, wherein said reed is maintained in contact with said plate member by an interference fit between said plate member, said reed and said support member.

10. The game calling device of claim 1, wherein said control rod has a roller on one end for making contact with said reed.

11. The game calling device of claim 1, wherein said elastic skin urges the control rod against the reed.

12. The game calling device of claim 1, wherein said elastic skin maintains the control rod in a desired position against the reed.

13. The game calling device of claim 1, wherein the control rod creates a protrusion in the elastic skin that provides a visual indication of the vibrational length of the reed.

14. The game calling device of claim 10, wherein said control rod has a handle on an opposite end from said roller to enable the user to manipulate the control rod.

15. A game calling device comprising:

a tubular member having a mouthpiece end and an inlet end;

a reed supported in the tubular member in an axial direction of the tubular member and having a fixed end and a vibrational length that vibrates in response to air passing through the tubular member; and a control rod extending axially within the tubular member and including a contact end that makes movable contact with the reed and an opposite end that extends in the axial direction outside the mouthpiece, wherein air passing through said tubular member and past said reed vibrates the reed to create sounds and the control rod modifies the vibrational length of the reed by contacting a selected point of contact of the control rod on the reed through axial manipulation of the control rod by mouth, wherein said mouthpiece includes a support member to support said reed and said plate member for selective axial positioning in the axial direction within the mouthpiece and the control rod extends through a hole in the support member.

16. The game calling device of claim 15, wherein the opposite end of the control rod is a hooked end for manipulation.

17. The game calling device of claim 15, wherein said mouthpiece includes a plate member having an air channel extending in an axial direction below the reed.

18. The game calling device of claim 15, wherein one end of said reed is connected to said plate member and an opposite end is free to vibrate.

19. The game calling device of claim 15, wherein said air channel terminates at an upstream end delimited by an end wall of said plate member that directs air towards said reed.

20. A method of varying sounds produced by a reed within a game calling device, the game calling device having a tubular member with a support member for supporting a reed and plate member for channeling air to the reed, an outlet end that emits sounds from the air entering the tubular member from a mouthpiece end and exciting said reed, an opening in a wall of said tubular member adjacent said mouthpiece end and said outlet end, said opening being at least partially covered by an elastic member and a control rod that makes movable contact with the reed, comprising the steps of:

conveying air through said mouthpiece end and past said reed, thereby causing said reed to vibrate and to produce sounds that emanate from said outlet end;

selectively positioning the control rod such that contact is made with the reed at a variable location on the reed, thereby varying the sound emitted from the device; and urging the control rod against the reed by positioning the control rod in the opening and between the elastic member and the reed to locate the control rod in a desired position on the reed.

21. A method of varying sounds produced by a reed within a game calling device, the game calling device having a tubular member with a mouthpiece having a support member for supporting a reed and plate member for channeling air to the reed, an outlet end that emits sounds caused by the air entering the tubular member and exciting said reed, and a control rod that protrudes from the mouthpiece and makes movable contact with the reed, comprising the steps of:

conveying air through said mouthpiece end and past said reed, thereby causing said reed to vibrate and to produce sounds that eminate from said outlet end; and selectively positioning the control rod by mouth such that contact is made with the reed at variable locations on the reed, thereby varying the sound emitted from the device.

* * * * *